United States Patent [19]

Gaudy et al.

[11] 3,935,910

[45] Feb. 3, 1976

[54] METHOD AND APPARATUS FOR MOULDING PROTECTIVE TUBING SIMULTANEOUSLY WITH BORE HOLE DRILLING

[75] Inventors: Claude François Gaudy, Bry-sur-Marne; Adrien Giraud, Neuilly; Claude J. Tassin, Courbevoie; Christian H. Pech, Chatou, all of France

[73] Assignee: Compagnie Francaise des Petroles, Paris, France

[22] Filed: June 25, 1974

[21] Appl. No.: 482,703

[30] Foreign Application Priority Data

June 25, 1973 France ..... 73.23084

[52] U.S. Cl. ..... 175/17; 61/41 A; 61/84; 166/295; 166/288; 175/72; 175/50; 175/171; 61/72.2

[51] Int. Cl.[2] ..... E21B 7/00

[58] Field of Search ..... 175/72, 17, 99, 94, 171, 175/50; 166/288, 277, 295; 61/41, 45, 84

[56] References Cited

UNITED STATES PATENTS

| | | | |
|---|---|---|---|
| 512,037 | 1/1894 | Kraus | 61/72.2 |
| 978,359 | 12/1910 | Cooper | 166/288 |
| 1,351,137 | 8/1920 | Sheen | 61/84 |
| 2,609,052 | 9/1952 | Kanzer | 166/288 |
| 2,946,578 | 7/1960 | Smaele | 175/99 X |
| 3,126,959 | 3/1964 | Ortloff | 166/288 |
| 3,255,833 | 6/1966 | Kerr | 175/24 |
| 3,328,971 | 7/1967 | Boessner | 61/84 |
| 3,444,279 | 5/1969 | Dost | 61/72.2 X |
| 3,788,087 | 1/1974 | Patin | 61/84 |

*Primary Examiner*—Ernest R. Purser
*Assistant Examiner*—Richard E. Favreau
*Attorney, Agent, or Firm*—Sughrue, Rothwell, Mion, Zinn & Macpeak

[57] ABSTRACT

In a method of drilling a bore-hole, the bore-hole is protected against caving in as the drilling proceeds by the simultaneous moulding of a tubing on the bore-hole wall immediately above the drill tool. Preferably a sleeve is first moulded onto the bore-hole wall and the tubing is moulded onto the sleeve.

20 Claims, 8 Drawing Figures

Figure 1:
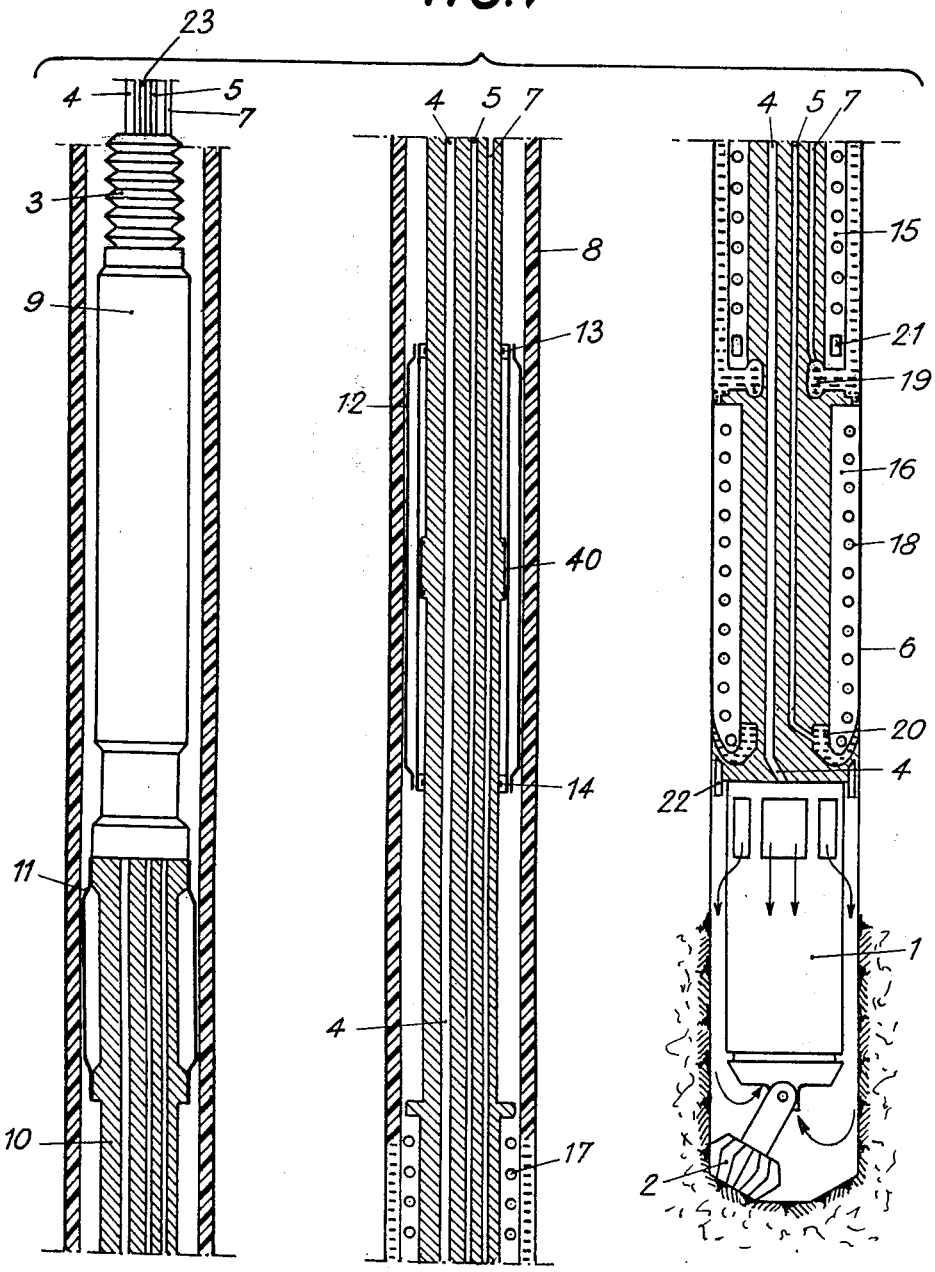

METHOD AND APPARATUS FOR MOULDING PROTECTIVE TUBING SIMULTANEOUSLY WITH BORE HOLE DRILLING

The present invention is concerned with bore hole drilling and in particular to the protection of the bore hole against caving in.

Known methods, in spite of the progress achieved, all have the common characteristic of protecting the drilled hole against caving in of the strata passed through by means of tubes which are sent down as the drilling descends. This type of protection which is costly, due both to the time required to place it in position and manhandling as well as due to the tubes used, is particularly troublesome in the case where drilling methods, known as rotary drilling methods are employed, because a loss of power, due to rubbing of the drilling tool drive shaft against the walls of the bore hole, is added to the said disadvantage. This loss of power may be considerable because this shaft may be as much as several miles in length. Furthermore, when the tools require changing it is necessary to raise the drive shaft, which comprises lengths of rod screwed one into the other, and unscrew it thus increasing the cost price for this type of protection.

The method of bore-hole drilling called "flexidrilling" achieves a net advance over rotary methods because the drive shaft is replaced by a flexible armoured hose for the tool driving motor and the said flexible hose can be wound up or unwound by means of a drum. In addition, the space taken up by the drilling platform can be reduced in size. However this method does not dispense with the necessity of protecting the drilled hole using steel tubes to prevent caving in of the strata. Furthermore, it is essential to ensure a perfect seal round the flexible hose so as to avoid the considerable danger if an eruption occurs.

According to this invention there is provided a method of bore-hole drilling characterized by the fact the drilled hole is protected against the caving in of strata and ingress of water by tubing which is moulded around the wall of the drilled strata.

Thus, on the surface, instead of having a large stock of pipes always available, which are assembled one to the other as drilling progresses, it is only necessary to have available a stock of moulding products which are tipped into appropriate tanks, from where the products are led into a tube former located at the bottom of the bore-hole and above the drilling tool.

Advantageously, tube moulding process proceeds as the drilling tool advances down through the strata.

This method is particularly advantageous because the strata can be supported immediately after drilling and all that is required is to connect the tube former and tool holder by any suitable means in order to use this method.

Preferably the portion of tube in the process of being moulded is protected from the drilled strata by a sleeve which is moulded below it.

It is interesting to note that use of this method thus enables the tube to be effectively protected during its moulding process because it is enough to ensure that the sleeve former and tool holder are effectively sealed for the tube former to be protected from the strata and, as a result, all water ingress.

Other advantages and characteristics of the invention will become apparent during the course of the following description given with reference to the attached drawings, which illustrates an embodiment of the method and machine according to the invention.

Figure 2:
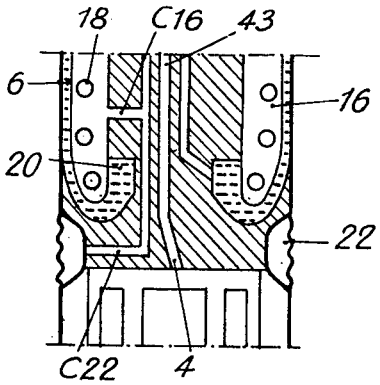
Figure 6:
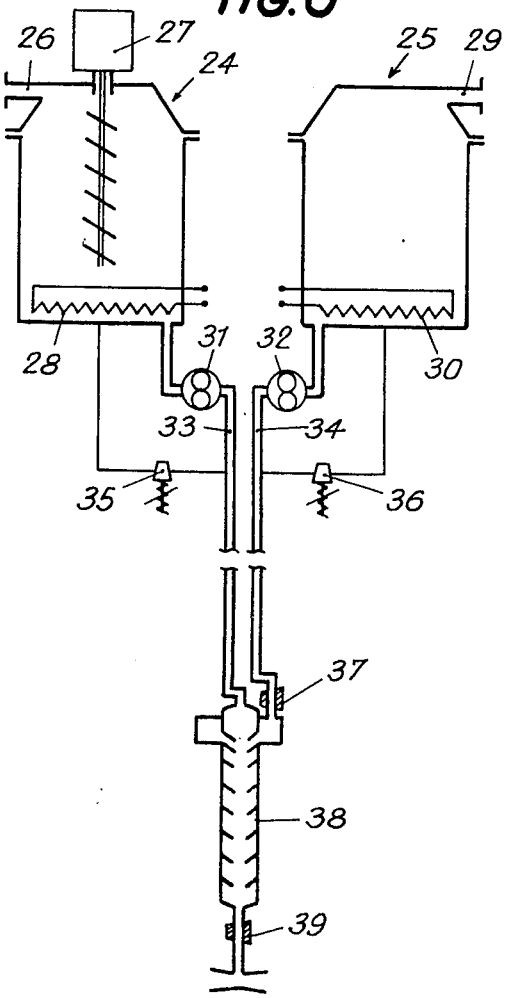
Figure 7:
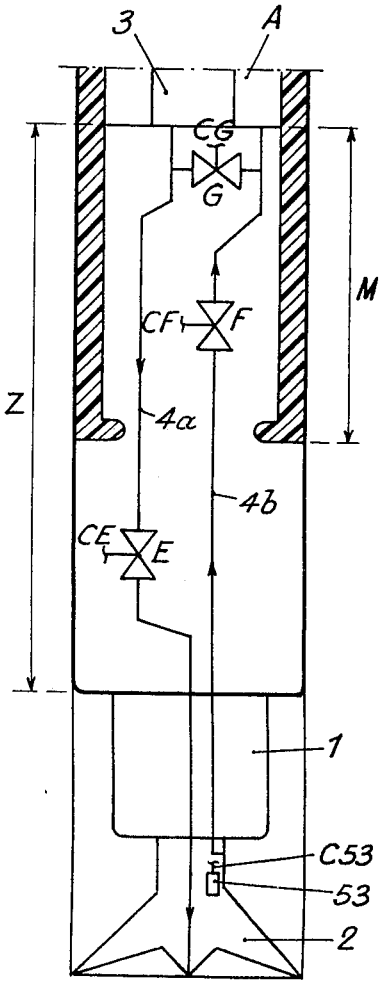
Figure 8:
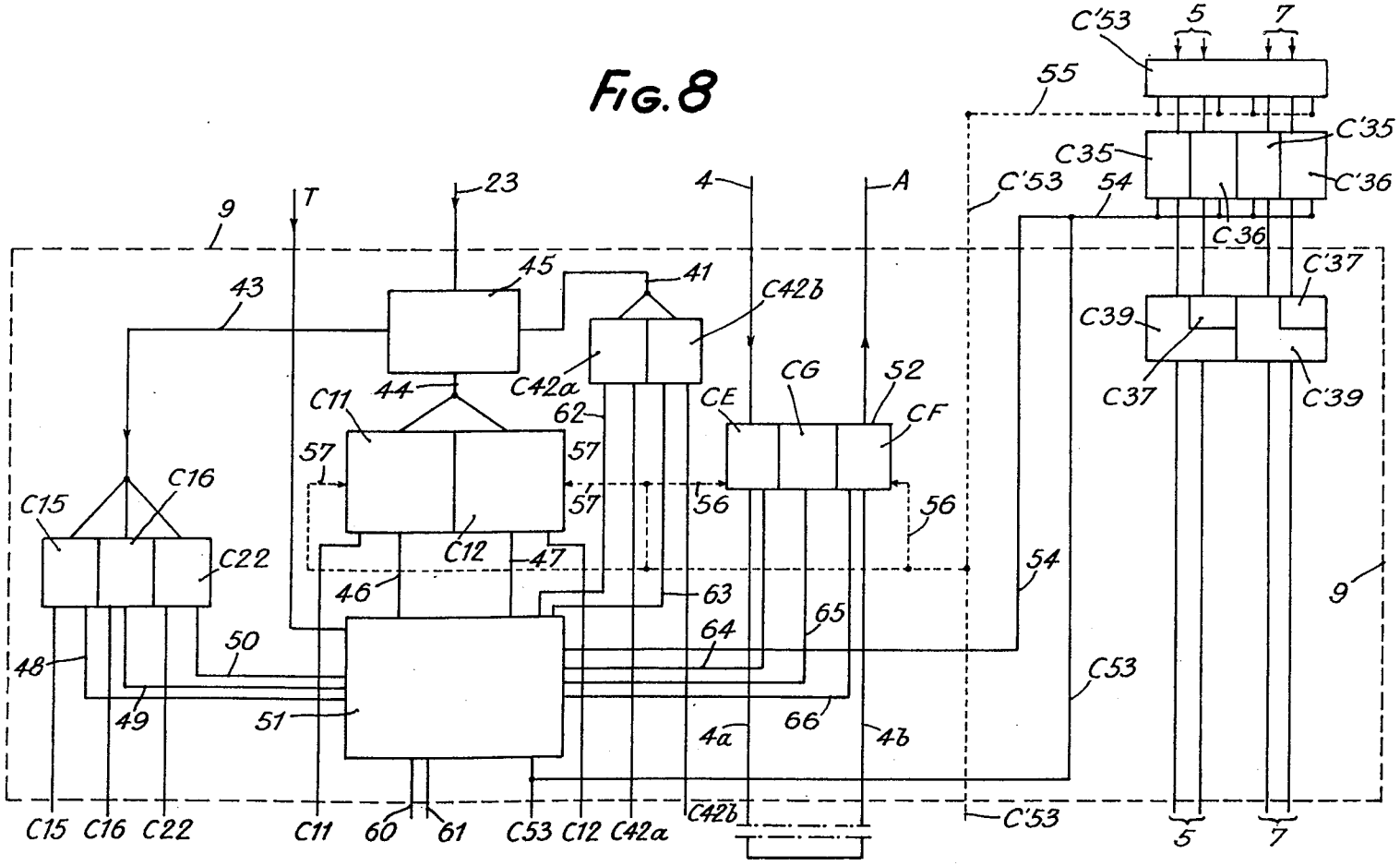

In the drawings:

FIG. 1 is a diagrammatic view in cross section of the lower part of a tubing and the machine for making it, FIG. 2 is a diagrammatic view in cross section of a part of the machine of FIG. 1, FIGS. 3, 4 and 5 are diagrammatic illustrations of the means of advancing the tool in three different stages, FIG. 6 is the diagrammatic illustration of the supply circuit for the materials used in moulding the tubing, FIG. 7 is the diagrammatic illustration of the drilling mud circuit, and FIG. 8 is the diagrammatic illustration of the main controls for controlling the descent of the drill.

Motor 1, in FIG. 1, driving a retractable drill tool 2, may be a turbine or an electric motor. It is lowered by means of a flexible hose 3 or similar means inside which are fitted all the circuits required to supply the motor, to supply the oil circuits controlling the progress of the drill and for mud circulation. In order not to uselessly overcrowd the drawing, only an oil feed channel 23, a mud circuit 4, a single material feed circuit 5 for moulding a sleeve 6 and a single material feed circuit 7 for moulding a tubing 8 are illustrated.

These various circuits are placed under the control of a control unit 9 below which a body 10 is located carrying two inflatable sleeves 11 and 12. Sleeve 11, fast with body 10, enables all the equipment illustrated to be supported after inflation whereas sleeve 12, fast with a cylinder 42, slides with the said cylinder up and down body 10 by means of sealing rings 13 and 14, thus enabling tool driving motor 1 and all the equipment to be moved after inflation of sleeve 12.

The equipment for making the tubing 6 and 8 comprises two tube formers 15 and 16 provided with heating elements 17 and 18 and injection zones 19 and 20 receiving respectively the materials for making the tubing 8 through circuit 7 and for making sleeve 6 through circuit 5.

The material which is used for making tubing 8 may be of the resin or cement type having, for example, a resistance to compression greater than 2,500 bars and a resistance to traction greater than 700 bars over a temperature range of between 0° and 150°C, the viscosity being less than 70 poises.

As an example, tubing 8 may be made up of a polymerised epoxy resin. The thermohardening resin is injected at a pressure of approximately 30 bars above the pressure existing at the base of the drill. The resin is cooled by a ring 21, in which a cooling liquid, e.g., mud, circulates, thus preventing a risk of polymerisation in the injection zone 19. Heating elements 17 and 18, on the other hand, ensure polymerization of the injected material.

Sleeve 6, in the example chosen, is a silicone elastomer resin (trade name "Silastene") which is extruded and which possesses the characteristic of polymerising well in water. A retractable shield 22, consisting of an inflatable sleeve, which can be seen in the inflated position in FIG. 2, ensures protection of sleeve 6 during its formation by preventing fragments or rock particles from being included in the sleeve, which, if included, might well become water ingress points.

Tube formers 15 and 16 are units which are inflated in the same manner as shield 22 by the oil circuit 23. To raise the tool-tube former assembly all that is necessary is to slightly deflate units 15 and 16.

The resin supply circuits used to make the protective sleeve 6 and tubing 8 are similar to those illustrated in FIG. 6. For each type of resin to suit respectively sleeve 6 or tube 8 there is on the surface one tank 24 used for the preparation of the basic material and one tank 25 used for the preparation of the hardener. A vacuum pressure device illustrated diagrammatically by pipe 26 ensures that fumes from the material are extracted. Mixer 27 is designed to homogenize the resin base assembly, heated by heating element 28. The base added to the resin is designed to increase the resin's mechanical properties and its thermal conductivity. It may be, for example, of a metallic nature.

Tank 25, used for the preparation of the hardener, comprises in the same manner a vacuum pressure device, not illustrated, connected to pipe 29 for hardener fume extraction, and a heating element 30.

Pumps 31 and 32 are metering pumps incorporated in resin hose 33 and in hardener hose 34. Safety valves 35 and 36, enabling a return to be made to tanks 24 and 25 respectively in the event of abnormal pressure in flexible hose 3, are adjusted to suit the drilling depth thus ensuring an injection pressure for the resins at formers 15 and 16 which is 30 bars higher than that at the bottom. Flexible hoses 33 and 34 are heated thus ensuring that the viscosity of the material is not lowered. A valve 37 enables the introduction of hardener into a static mixer 38 to be stopped. This allows static mixer 38 to be drained of hardener, in the event of a temporary stop in drilling, before valve 39, which controls the feed of resin to injection zones 19 or 20, according to whether tubing 8 or sleeve 6 is being made, is closed. It will be understood that two assemblies exit similar to that shown in FIG. 6, one for the sleeve 6, the other for the tubing 8.

Thus it will be understood that circuits 5 and 7, illustrated in FIG. 1, each comprise two channels, one for the resin and the other for the hardener, the channel for the latter being provided with a valve such as 37 located on the inlet side of a static mixer such as 38. Likewise, valves such as 39 control the flow of each of the resins and they are located one in channel 7 near injection zone 19 and the other in channel 5 near injection zone 20.

Figure 3:
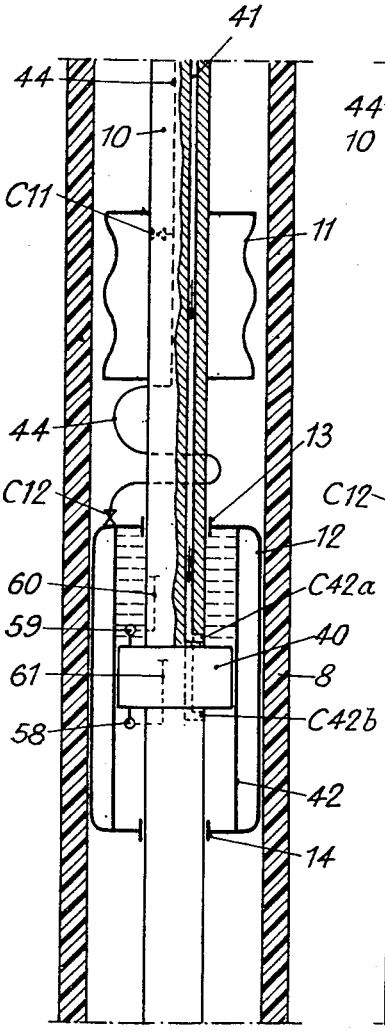
Figure 4:
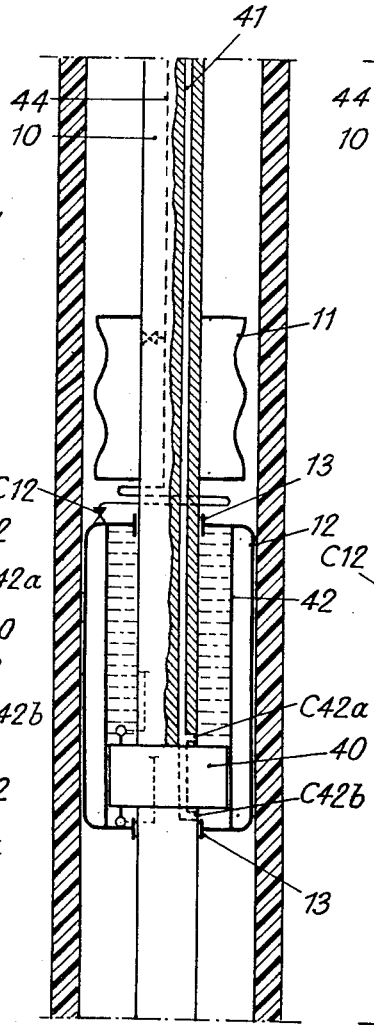
Figure 5:
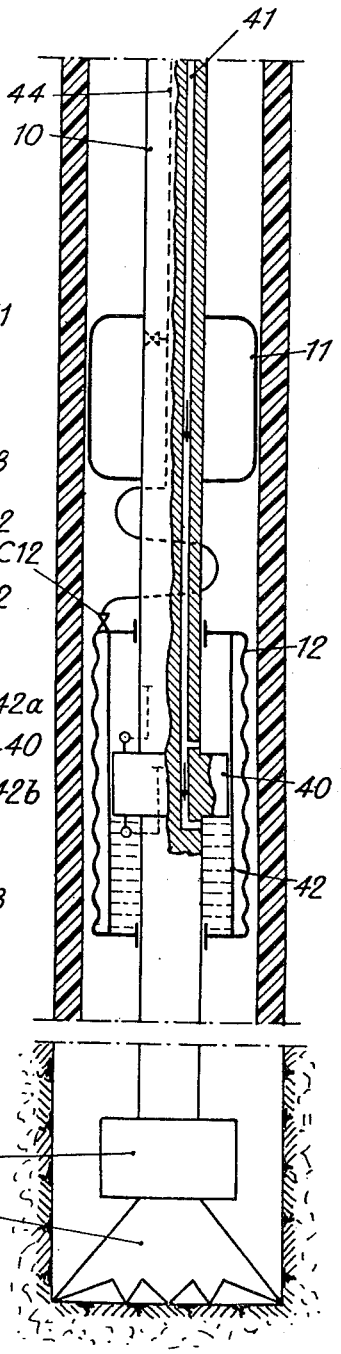

The advancement of drilling and the forming of tubing 8 and its sleeve 6 are carried out as illustrated diagrammatically in FIGS. 3 to 5. In FIG. 3, sleeves 11 and 12 are illustrated deflated and inflated respectively. Sleeve 11 is fast with body 10 and descends with body 10 as a result of oil pressure, in the general circuit 23, exerted on piston 40, fast with body 10, under the control of control unit 9 (FIG. 8). Oil entering the top part of cylinder 42 via circuit 41 pushes the piston down, sleeve 12 remaining firmly applied against tubing 8 by previous inflation of the sleeve. Thus, as tool 2 progresses downwards, body 10 descends relative to sleeve 12. Formers 15 and 16 fast with body 10 also descend and, during this movement, a certain amount of resin is extruded in zone 20 to form sleeve 6, the resin for gradually polymerizing in the areas where heating elements 18 are inserted, whereas resin extruded in zone 19, the flow of which is different from the resin used in the making of sleeve 6, polymerizes near heating elements 17 to form tubing 8. It is of course understood that the quantities injected are in proportion to the downward progress of the tool and the thickness of the respective sleeve or tubing. For example, the sleeve 6 may be about 10 mm thick and the tubing 8 about 50 mm thick. The control unit 9 controls the supply of resins.

The tool continues to advance downwards until piston 40 reaches the bottom of cylinder 42, FIG. 4. This leads to the immediate inflation of sleeve 11, FIG. 5, which holds the body 10 while sleeve 12 is deflated to enable it to take up a lower position as the result of injection of oil into the part of cylinder 42 located below piston 40. The automatic inflation of sleeve 11 may be ensured by an electrical impulse from an end of stroke stop 58, the impulse being transmitted by wire 61 to control unit 9, FIG. 8. As solenoid flap valve control circuits which control hydraulic feed to the hydraulic circuits are well known, details of the various circuits ensuring inflation and deflation of the sleeves have not been illustrated. Thus, during a period of time which may be very short, sleeve 12 moves down to a lower level so that when the top of cylinder 42 is close to piston 40, all that is necessary is to apply oil under pressure once again inside sleeve 12 and release the pressure inside sleeve 11 to return to the initial conditions illustrated in FIG. 3. For this purpose an end of stroke stop 59 may be used which sends a releasing impulse by wire 60 to control unit 9 (FIGS. 1 and 8). In FIG. 8, then, are found the oil circuit 23, resin supply circuits 5 and 7 and mud circuit 4 comprising a down channel **4*a* and an up channel 4*b* in zone Z, FIG. 7**.

A high pressure pump 45 supplies the oil necessary to inflate formers 15, 16, shield 22 and sleeves 11 and 12. A first circuit 43 leads to controls C15, C16 and C22 for inflating formers 15, 16 and shield 22. In the same way a second circuit 44 leads to controls C11 and C12 for sleeves 11 and 12. The assembly of circuits 48, 49 and 50 controlling controls C15, C16, and C22, and circuits 46 and 47 controlling controls C11 and C12 are placed under the control of the general control 51 for advancing or stopping the forming machine and in consequence piston 40, the movement of which depends on the oil fed via circuit 41. Circuit 41, serving channels **C42*a* and C42*b* controlled by control channels 62 and 63 from the general control 51, enables, via channel C42*a*, the drill to advance downwards and the sleeve 6 and tubing 8 forming machine to descend simultaneously, and enables, via channel C42*b*, cylinder 42 to descend after deflation of sleeve 12. Wires 61 and 60 transmit the impulses sent out by the end of stroke stops 58 and 59 to the general control 51 in order to control the automatic setting in motion of the inflating and deflating operations for sleeves 11 and 12 via control channels 46 and 47. The mud circuit 4 is also placed under the control of controls CE, CF and CG for three valves E,F,G (FIG. 7), these controls being placed under the control of control unit 51 by channels 64, 65 and 66. Valves E and F may be closed in the event of the forming machine being stopped or due to detection of a high pressure zone by detector 53 coupled to control unit 51 by C53. In this illustration, the zone including the tube making machine, and the inflatable sleeves, has been indicated by the letter Z. The moulding zone has been indicated by the letter M. As far as the mud circuit is concerned, it is seen that it is fed in by flexible hose 3 and returned by channel 4*b* in annular section A. Supply circuits 5 and 7 for resins and hardeners are placed under the control of controls C35, C36 and C'35, C'36 as well as controls C37 and C'37 controlling valves 37 for the hardener circuits and C39 and C'39 controlling valves 39 for the resins supply. A channel 54 connects control unit 51 to controls C35 to C'36 thus bringing the resin flow under a control relative to the speed of advance by any desired method, channel C53 also enabling this flow to be brought under a control relative to the pressure existing at the bottom of the drilling transmitted by pressure sensor 53 by any desired method. Control unit 51** is operated consequently from the surface by line T.

In addition to these controls, a dotted line C'53 has been illustrated to show a special connection the object of which is to send a signal set in motion by very high pressure or an eruption. This signal, by means of connection 55, enables the flow of resins to be stopped and the heating of heating elements 17 and 18 of formers 15 and 16 to be switched off, by means of connection 56 for controlling the closure of the mud circuit valves E and F and by means of connection 57 for controlling the inflation of sleeves 11 and 12, with the object of locking the machine and proceeding to insert a cement plug.

As these various circuits can be of any form and as they are not part of the invention insofar as the application of the units, which can be obtained from trade sources, is concerned, it has not been deemed necessary to illustrate in detail each control, whose structure may take any form. The control of resin flow limits such flows to a rate of increase of 10%. Thus, even if the bore hole passes through an underground cavern which may be present in the strata, the increase in resin flow will only lead to a slight increase in sleeve and tubing thicknesses in the region of the cavern. Again it will be noted that although such caverns are usually filled with water, it is always possible to make the sleeve because the material thereof is selected to be able to polymerise in water. As the tubing is protected by the sleeve, the tubing can still be moulded normally.

If drilling must be interrupted, the flow of hardener is stopped by means of valves 37 and the resin circuits are drained of hardener. If drilling recommences, a start is made by machining the inner wall of the boottom part of the tubing a few yards above the bottom of the drilling. Thus the retractable tool 2, during its descent, advances its head gradually downwards in the tubing and cuts a wall in a truncated shape until meeting up with the protecting sleeve. This truncated shape cutting may alternatively be carried out by a boring sleeve, this sleeve being located just above the drilling tool. If a cement plug has been poured, it is broken up by means of the drilling tool, the pressure at the bottom being contained by the clamps on the machine in the conventional way. When former 15 reaches the point where the truncated portion commences, resin is injected without hardener thus forcing out the mud, then the controls are set for the feed of hardener and resin. While the machine is descending and as soon as former 16 reaches the bottom end of the truncated cone, the controls are set for forming the outer sleeve. In this manner a perfect joint is made between the earlier tubing and a new section of tubing, tthe end of the new sleeve being held between two truncated layers of tubing resin. Thus the machine constructed enables a perfect tubing joint to be made after an interruption.

It is self-evident that the thermohardening materials which may be used to form the sleeve and tubing can be of any sort provided that their mechanical properties are sufficient to take the place of conventional tubing. Thus the invention encompasses the case of forming a tubing 8 without making a sleeve 6.

In addition to the above-mentioned applications, that is to say bore-hole drilling with simultaneous forming of tubing continuously, the stopping and the restarting of the downward advance, the machine can also be used to make the internal sleeving of the tubes even if filled with water or to make the internal sleeving of a punctured or completely oxidized tube.

Finally, the controls for advancing the tool downwards by means of sleeves 11, 12 and cylinder 42, can be reversed to return the assembly to a desired depth, as for example when restarting the tubing process with the object of connecting it to the previously formed portion.

What is claimed is:

1. A machine for exploratory drilling comprising a drilling tool; a motor for rotating the tool; a supporting body, an inflatable sleeve former on said body for forming a sleeve, said sleeve former having heating elements and an injection zone at its lower end; an inflatable tubing former on said body disposed above said sleeve former, for forming a tubing, said tubing former having heating elements and an injection zone at its lower end; and feed circuits for feeding sleeve moulding material to the injection zone of the sleeve former and for feeding tubing moulding material to the injection zone of the tubing former, wherein said motor is mounted below said body.

2. A machine according to claim 1, in which said body carries an inflatable annular shield around a lower portion immediately below the injection zone for the sleeve former.

3. A machine according to claim 1 in which said tubing former includes cooling means between the injection zone and the heating elements.

4. A machine for exploratory drilling comprising: a drilling tool; a supporting body for supporting said drilling tool; a motor for rotating the tool, said motor mounted below said supporting body; a tubing former on said body for forming a tubing, said former having an injection zone at its lower end; and feed circuits for feeding tubing moulding material to the injection zone, the feed circuits comprising a first channel for a thermohardening resin or cement and a second channel for a hardener, said channels feeding into a static mixer immediately upstream of the injection zone of said tubing former, a first valve controlling the supply of hardener to said static mixer and a second valve controlling the supply of the mixed materials to said injection zone.

5. A machine for exploratory drilling comprising: a drilling tool; a supporting body for supporting said drilling tool; a motor for rotating the tool, said motor mounted below said supporting body; a first inflatable annular sleeve fixed to said body; a second inflatable annular sleeve movably attached to said body; a hydraulic jack to control the movement of the second annular sleeve with respect to said body; a tubing former on said body for forming a tubing, said former having an injection zone at its lower end; and feed circuits for feeding tubing moulding material to the injection zone of the tubing former.

6. A machine according to claim 5 in which said second inflatable annular sleeve is mounted on a cylinder the ends of which have seals slidable on an external cylindrical portion of said body, the body having a ring thereon which divides the interior of said cylinder into two annular chambers, and inlet and outlet orifices for feeding oil to said chambers.

7. A machine according to claim 6, in which a top part of said body includes control means for controlling mud circulation, operating oil circulation, moulding materials circulation and heating circuits.

8. A machine according to claim 1 further including a pressure sensor which senses the pressure in the bottom of the drilling, and means connecting said pressure sensor to said control means to control the flow of moulding material when said pressure exceeds a predetermined value.

9. A machine according to claim 8 in which said control means act on reception of an impulse from the pressure sensor such that, when the pressure exceeds a predetermined valve, said control means cause the delivery of mud to the drill tool to stop, both the first and second sleeves to inflate, hardener delivery valves to close, delivery valves for the moulding materials to close at the outlet from the static mixers once the said mixers have been drained of hardener, the switching off of the heating element circuits and a halt to the machine's progress downwards.

10. A machine according to claim 8 in which said control means include means for automatically setting in motion the inflation of said first sleeve, deflation of said second sleeve and its descent under the control of a first end of stroke stop in said hydraulic jack, a second end of stroke stop being connected to means for setting in motion inflation of said second sleeve, deflation of said first sleeve and the filling of said other annular chamber in said hydraulic jack.

11. A method of exploratory drilling utilizing a drilling tool supported by means having at least one expandable member located thereon comprising the steps of:

a. drilling a hole by passing the drilling tool downwardly through the earth;
b. moulding a tubing around the wall of the drilled hole simultaneously with the downward movement of the drilling tool, to prevent caving in of the strata and ingress of water;
c. expanding said expandable member laterally against the molded tubing so as to prevent relative movement between said expandable member and said tubing;
d. exerting a force between the stationary expandable member and the drilling tool to cause the drilling tool to progress downwardly.

12. The method of claim 11 wherein the moulding comprises the further step of:

a. extruding the tubing material through an injection zone around the wall of the drilled hole; and
b. moving the injection zone downwardly through the hole parallel to the drilling axis.

13. The method of claim 11 wherein the moulding comprises the further steps of:

a. extruding a flowable thermohardening material through an injection zone around the wall of the drilled hole;
b. moving the injection zone downwardly through the hole parallel to the drilling axis; and
c. heating the extruded thermohardening material to cause same to harden.

14. The method of claim 13 comprising the further step of cooling the thermohardening material prior to heating the material to cause it to harden.

15. The method of claim 11 comprising the additional step of moulding a sleeve directly against the wall of the drilled hole prior to the moulding of the tubing.

16. The method of claim 15 wherein the moulding of the sleeve comprises the steps of:

a. extruding the sleeve material through an injection zone onto the wall of the drilled hole; and
b. heating the sleeve material after placing it onto the wall.

17. The method of claim 15 including the additional step of erecting a shield between the drilling tool support means and the wall of the drilled hole prior to the moulding of said sleeve, to prevent water from contacting said moulded sleeve.

18. The method of claim 15 including the additional step of erecting a shield between the drilling tool support means and the wall of the drilled hole prior to the moulding of said sleeve so as to exclude rock particles and fragments from the moulding of the sleeve.

19. The method of claim 15 comprising the additional step of controlling the moulding of the sleeve and the tubing so as to maintain a constant thickness of both the sleeve and the tubing when passing through an underground cavern.

20. A method according to claim 15, in which the material of said sleeve is such that polymerization of said sleeve takes place in the presence of water.

* * * * *

UNITED STATES PATENT AND TRADEMARK OFFICE

CERTIFICATE OF CORRECTION

PATENT NO. : 3,935,910

DATED : February 3, 1976

INVENTOR(S) : Claude F. GAUDY et al

It is certified that error appears in the above-identified patent and that said Letters Patent are hereby corrected as shown below:

IN THE CLAIMS:

Column 7, line 5, delete "1", and insert --7--.

Column 7, line 14, delete "valve", and insert --value--.

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*